United States Patent [19]

Lou

[11] 4,065,650

[45] Dec. 27, 1977

[54] ELECTRONIC CALCULATOR WITH SWITCHES IN SOLID V- AND U-SHAPED GROUPS

[76] Inventor: Kwong-Li Lou, c/o Air Asia Co., Ltd., Quality Control Divison, Tainan, Taiwan 700, China /Taiwan

[21] Appl. No.: 725,233

[22] Filed: Sept. 21, 1976

[51] Int. Cl.[2] ..... H01H 13/70

[52] U.S. Cl. ..... 200/5 R; 200/5 A; 235/145 R; 340/365 R

[58] Field of Search ..... 200/1 R, 1 B, 6 A, 5 R, 200/5 A, 52 R, 157, 159, 4, 329, 330, 340, DIG. 1, DIG. 2, 159 R, 159 B; 178/101; 197/98-103; 235/145 R; 335/206; 340/365 R

[56] References Cited

U.S. PATENT DOCUMENTS

| | | | |
|---|---|---|---|
| 1,823,809 | 9/1931 | Varner et al. | 200/61.27 |
| 3,319,884 | 5/1967 | Franklin | 235/145 R |
| 3,428,747 | 2/1969 | Alferieff | 340/365 R X |
| 3,684,842 | 8/1972 | Boulanger | 200/159 B X |
| 3,700,836 | 10/1972 | Rackson | 200/DIG. 2 |
| 3,728,509 | 4/1973 | Shimojo | 200/159 B |
| 3,950,634 | 4/1976 | Speiser | 235/145 R |

FOREIGN PATENT DOCUMENTS

| | | | |
|---|---|---|---|
| 1,549,402 | 2/1971 | Germany | 235/145 R |

OTHER PUBLICATIONS

R. Seibel et al.; "Keyboard", *IBM Tech. Disc. Bull;* vol. 3; No. 6; Nov. 1960; p. 16.

D. Conway; "Digital "X" Typewriter Keyboard"; *IBM Tech. Disc. Bull.;* vol. 18; No. 12; May 1976; pp. 4187-4190.

D.C. Kowalski; "Semi-Captive Keyboard"; Xerox Disclosure Journal; vol. 1; No. 2; Feb. 1976; p. 85.

*Primary Examiner*—James R. Scott

*Attorney, Agent, or Firm*—Oblon, Fisher, Spivak, McClelland & Maier

[57] ABSTRACT

In a hand-operated electronic calculator, a switchboard having push-button switches for digits and symbols, every two or more switches combined into V, or U, or square shaped groups either above the surface or recessed for receiving fingertips and actuated along two or more directions. Switch groups are arranged at finger locations, each group of switches being assigned to a certain finger, two or more groups to active fingers, and a group can be at a perpendicular direction to the other four fingers for thumb operating.

8 Claims, 4 Drawing Figures

ELECTRONIC CALCULATOR WITH SWITCHES IN SOLID V- AND U-SHAPED GROUPS

BACKGROUND OF THE INVENTION

1. Field of the Invention

The present invention relates generally to electronic calculators.

2. Description of the Prior Art

In existing electronic calculators having a switchboard, the push-button switches for digits and symbols are all installed on the same level and actuated downward. With electronic parts greatly developed and improved, electronic calculators are made pocket size, convenient for carrying. Accordingly, the push-button switches are small and close together making finger operation very inconvenient, and causing errors, in addition to requiring watching.

BRIEF SUMMARY OF THE INVENTION

It is therefore one object of the present invention to provide an improved switchboard for an electronic calculator permitting push-button switches to be actuated in two, or several directions without need for much eye attention.

The object of the present invention is achieved by a switchboard in a hand-operated electronic calculator having at least one solid group of push-button switches for receiving a user's fingertip, the group including at least one upright button.

The foregoing as well as other objects, features, and advantages of the present invention will become more apparent from the following description taken in conjunction with the appended drawings.

DESCRIPTION OF THE INVENTION

Figure 1:
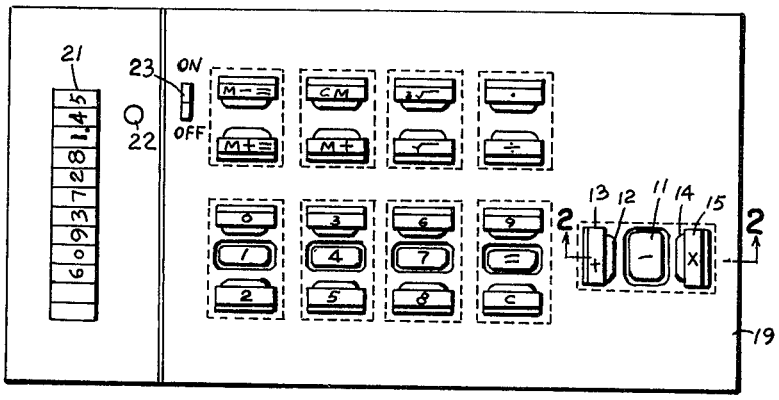
FIG. 1 is an elevational view of the switchboard of an electronic calculator showing push-button switches in groups.
Figure 2:
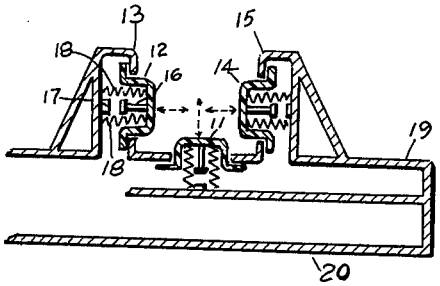
FIG. 2 is an enlarged sectional plan view taken in the plane indicated by line 2—2 in FIG. 1 with electronic parts and wiring omitted therefrom for viewing clarity, showing typical push-button switches associated in a U-shaped group, three dotted arrows showing movable directions of the three push-buttons.
Figure 3:
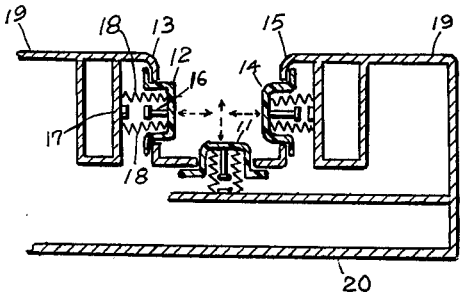
FIG. 3 is also an enlarged sectional plan view like FIG. 2 with the calculator surface changed to the upper plane so that the push-button switches are recessed in appearance.

Referring to FIGS. 1, 2 and 3, the push-button switches 11, 12 and 14 are associated at the bottom and at opposing sides respectively of a U-shaped group. The push-buttons are actuated along vertical and level directions, as indicated by the three dotted arrows in FIGS. 2 and 3. The push-buttons 12 and 14 are moved in and out of fixed portions 13 and 15 respectively. The push-buttons are made of plastic material. Switch conductor 16 is a conducting terminal pin on the button 12. Fixed conductor 17 on the fixed portion 13 is adapted to make electrical connection with the conductor 16. Elastic materials, by way of example, either spring wire or sheet or sponge-like articles, 18 are used to keep push-button 12 normally at its outward position. When the user's fingertip pushes the push-button 12 leftward, it moves into the fixed portion 13 to the left inward position; and when the user's fingertip is released, the push-button 12 is pushed back out by the elastic material 18. When the push-button 12 is at its outward position, the conductors 16 and 17 are separated, and when the push-button 12 is at its inward position, the two conductors 16 and 17 contact one another. Wires or printed circuits are connected to the two conductors 16 and 17, (not shown in the FIGS. 2 and 3), so that as the two conductors on the push-button are separated or brought into contact, the electrical circuit is broken or completed accordingly. Similar construction is provided at buttons 11 and 14, so that each controls the completion of a circuit.

It is to be understood that the switch construction shown in FIGS. 2 and 3 is intended to be illustrative of the principles of operation only, and the invention is not limited to the configuration shown. Thus, for example, push-button switch groups may also be formed by two push-buttons in a V-shaped configuration, or formed by four push-buttons in a configuration with one at the bottom, one at the left, one at the right, and one at the front, as for the thumb; or formed by five push-buttons in a configuration with one at the bottom and four at the four sides, as for the forefinger. The push-button switch group for the thumb, as shown in FIG. 1 is approximately perpendicular to the switch groups, for the other finger locations.

The electronic calculator surface 19 and bottom 20 are connected by any convenient means. A soft layer, not shown in the drawing, may be patched onto the bottom 20 or the latter may be made rough to increase friction for positioning on a desk top, so that the calculator will not easily slide when operated. A numerical indicator 21 can be disposed at an end of the calculator. 22 is a light indicating that the power has been turned on. Switch groups which are not often used are associated in another row and are actuated by nearby fingers. 23 is a power switch.

FIG. 1 shows the calculator oriented for left hand use. When it is rotated 180°, it shows the calculator oriented for right hand use. There is no difference except the direction of operation is changed, for instance, wherein The left hand fingers push forward, the right hand fingers pull rearward.

When in use, the calculator is turned in one or the other of two positions. For left hand use, the calculator is turned so that the numerical indicator is on the left; for right hand use, the calculator is turned so that the numerical indicator is on the right. The turning of the calculator will not affect vision and reading. If in FIG. 1 the numerical indicator 21 is moved to the right side of the switchboard, the directions for turning the calculator would be reversed from that of the previous discussion.

Figure 4:
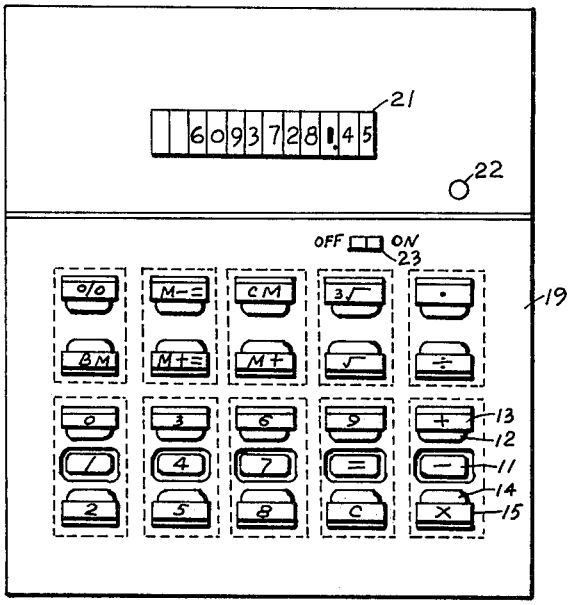
FIG. 4 is a modification of FIG. 1 showing a different arrangement of push-button switches.

Many modifications can be made, for instance:

1. In FIG. 1, the thumb actuating switch group can be eliminated and the numerical indicator 21 can be moved to the top of the switchboard so that it can be operated by either hand. This modification is shown in FIG. 4;
2. For a simple calculator, the switch groups can be arranged in one row and operated by three or four fingers;
3. FIG. 2 shows the switch groups above the calculator surface; FIG. 3 shows the switch groups recessed in the calculator surface;

4. The bottom push-botton 11 can be made larger than the side push-buttons 12 and 14 to form a shallow space.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In a hand-held electronic calculator including a housing having a substantially planar top surface, a switchboard comprising:

at least one solid group of push-button switches projecting above the top surface of said calculator housing for receiving a user's fingertip, said group including at least one upright push-button.

2. The hand-held electronic calculator recited in claim 1 wherein said group of push-button switches includes two upright push-buttons, said push-buttons being actuated by fingertip pushing and pulling according to the different orientations.

3. The hand-held electronic calculator recited in claim 1 wherein said group of push-button switches includes at least two upright push-buttons and one level push-button, said push-buttons being actuated by fingertip pressing, pushing and pulling according to the different orientations.

4. The hand-held electronic calculator recited in claim 1 wherein said group of push-button switches includes at least two upright push-buttons having opposed faces and one level push-button, said push-buttons being actuated by fingertip pressing, pushing and pulling according to the different orientations.

5. The hand-held electronic calculator recited in claim 1 wherein the housing has a rough bottom surface, so that the calculator will not slide when in use.

6. In a hand-held electronic calculator including a housing having a substantially planar top surface, a switchboard comprising:

a plurality of groups of push-button switches projecting above the top surface of said calculator housing for receiving the user's fingertips, at least one of said groups including an upright push-button, said groups of push-button switches being distributed in a one-to-one correspondence with each finger location, whereby each finger can cover a corresponding group of push-buttons, active fingers can cover at least two groups, and inactive fingers can cover less used groups.

7. The hand-held electronic calculator recited in claim 6 wherein said group of push-button switches for the forefinger comprises three buttons, with one at bottom and two at the forward and rear sides.

8. The calculator recited in claim 7 wherein said group of push-button switches for the thumb comprises three buttons with one at bottom, and two at the left and right sides and is located at a perpendicular position with respect to the other groups.

* * * * *